US005505051A

United States Patent [19]

Darredeau et al.

[11] Patent Number: 5,505,051

[45] Date of Patent: Apr. 9, 1996

[54] PROCESS FOR RESTARTING AN AUXILLIARY COLUMN FOR ARGON/OXYGEN SEPARATION BY DISTILLATION AND CORRESPONDING INSTALLATION

[75] Inventors: Bernard Darredeau, Sartrouville; Jean-Marc Peyron, Creteil, both of France

[73] Assignee: L'Air Liquide, Societe Anonyme pour l'Etude et l'Exploitation des Procedes Georges Claude, Paris Cedex, France

[21] Appl. No.: 396,741

[22] Filed: Mar. 1, 1995

[30] Foreign Application Priority Data

Mar. 2, 1994 [FR] France ..... 94 02374

[51] Int. Cl.[6] ..... F25J 3/04

[52] U.S. Cl. ..... 62/21; 62/22; 62/24; 62/37

[58] Field of Search ..... 62/21, 22, 37, 62/24

[56] References Cited

U.S. PATENT DOCUMENTS

| | | | |
|---|---|---|---|
| 3,912,476 | 10/1975 | Mikawa et al. | 62/37 |
| 4,784,677 | 11/1988 | Al-Chalabi | 62/37 |
| 4,994,098 | 2/1991 | Agrawal et al. | 62/22 |
| 5,084,081 | 1/1992 | Rohde | 62/22 |
| 5,209,070 | 5/1993 | Darredeau | 62/11 |
| 5,311,744 | 5/1994 | Sweeney et al. | 62/22 |
| 5,313,800 | 5/1994 | Howard et al. | 62/22 |
| 5,406,800 | 4/1995 | Bonaquist | 62/21 |
| 5,448,893 | 9/1995 | Howard et al. | 62/22 |

FOREIGN PATENT DOCUMENTS

| | | |
|---|---|---|
| 0446593 | 9/1991 | European Pat. Off. . |
| 3436987 | 4/1986 | Germany . |
| 53-106673 | 9/1978 | Japan . |
| 54-162679 | 12/1979 | Japan . |

*Primary Examiner*—Christopher Kilner
*Attorney, Agent, or Firm*—Young & Thompson

[57] ABSTRACT

During restarting an argon column (2), two valves (15, 17) provided at the output of a pump (3) are controlled while maintaining a constant level in the base of the argon column, at the outset at a predetermined first control level (N2), then while progressively lowering the controlled value of the constant level. Use in installations for air distillation whose argon column, of the packed type, has a sufficient height to purify the argon of oxygen to an oxygen content less than 100 ppm.

12 Claims, 6 Drawing Sheets

Figure 1:
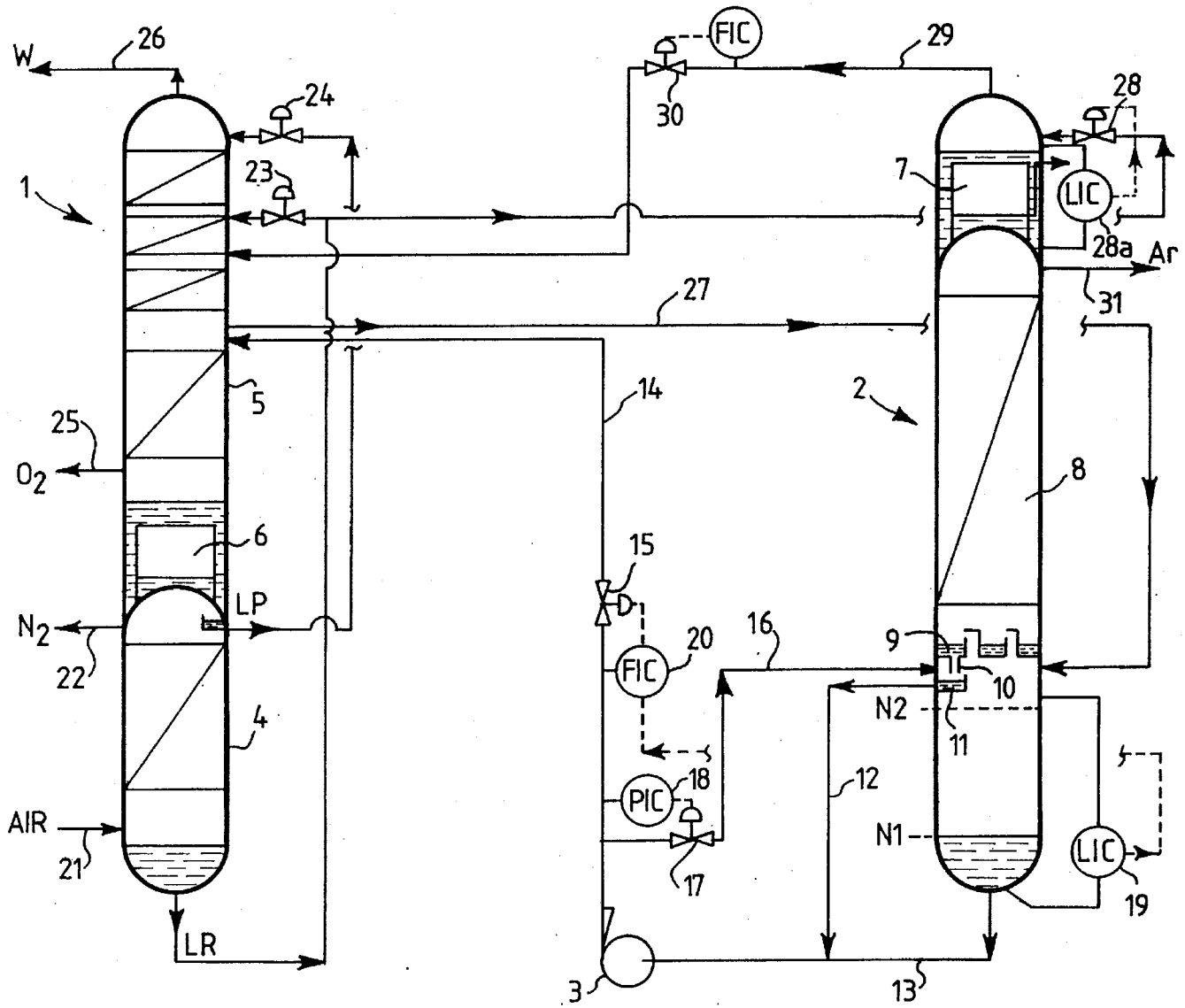

PROCESS FOR RESTARTING AN AUXILLIARY COLUMN FOR ARGON/OXYGEN SEPARATION BY DISTILLATION AND CORRESPONDING INSTALLATION

The present invention relates to a process for restarting an auxiliary column for argon/oxygen separation by distillation, coupled with a principal air distillation apparatus in which is carried out at least one oxygen/nitrogen separation, of the type in which the liquid in the auxiliary column is stored during stoppage of this latter. Then this liquid is recycled.

The invention relates in particular to air distillation installations, generally of the double distillation column type comprising a medium pressure column (or "MP column") and the low pressure column (or "LP column"), in which the auxiliary column, of a large height and of the packed type, permits effectuating by simple distillation a pressurized separation of oxygen and argon, to produce typically at its top gaseous argon containing less than 100 ppm (parts per million) of oxygen.

In such installations, the auxiliary column (which will also be designated in what follows by the term "argon column") treats very large gas and liquid flows relative to the argon production. As a result, the store of liquid accumulated in this column during normal operation represents several hours of production.

The reflux of the argon column is ensured by a head condenser in which the treated gas condenses by heat exchange with liquid rich in oxygen, called "rich liquid", from the MP column, which vaporizes at a pressure such that the gas resulting from this vaporization can be injected in the LP column. However, the gas enriched in argon from the LP column and supplying the argon column contains a little nitrogen. It can happen, during irregular operation of the LP column, that this gas contains substantially more nitrogen than intended. This nitrogen is in large part in the head of the argon column, where it concentrates in the gas which will be condensed, thus lowering its condensation temperature. As the pressure of the rich liquid which vaporizes should not fall below a certain limit (because the vapor must be returned to the LP column), it results that the temperature difference of the condenser falls and can even disappear, giving rise in its turn to a reduction or even a cancellation of the flow of condensed gas, and hence a stoppage of the arrival of gas rising in the argon column. If in this case the liquid which flows in the distillation section continues to be sent to the LP column, that causes to be emptied into this latter all the argon contained in the argon column. This excess of argon returns in large part to the base of the LP column, in the oxygen product, at such a point that the oxygen purity is lost, with serious consequences to the use of the installation.

The same problem arises in case of voluntary stoppage of the argon column.

The invention has for its object to permit, during restarting the argon column, a semi-complete recovery of the argon without substantial pollution of the principal air distillation apparatus.

To this end, the invention has for its object a process of the recited type, characterized in that:

- the base of the auxiliary column is connected to the principal apparatus by a liquid return conduit provided with a return valve;
- the inlet of the return valve is also connected to a device for the recovery of the liquid from the distillation section of the auxiliary column; and

- during restarting of the auxiliary column, the return valve is controlled while maintaining a constant level in the base of the auxiliary column, at the outset at a first predetermined control value, then by progressively reducing the control value of this constant level.

The process according to the invention can comprise one or more of the following characteristics:

- there is carried out in the principal distillation apparatus an argon/oxygen pre-separation in an argon pre-column whose base is directly connected, by a supply conduit for gas and by a liquid return conduit, to a column for separating oxygen/argon by distillation, and whose head is connected to the base of the auxiliary column by a supply conduit for gas and by said conduit (14) for liquid return;
- the liquid is caused to circulate in the return conduit by means of a pump mounted upstream of the return valve and whose inlet is connected directly to the base of the auxiliary column and to the recovery device;
- the outlet of the pump is also connected to the recovery device by a recirculation conduit provided with a recirculation valve;
- a portion of the liquid is stored in a collector connected to the output of the pump by a derivation conduit provided with a first valve, the bottom of this collector being connected to the inlet of the pump by another conduit provided with a second valve, the first valve being open and the second valve closed during stoppage of the auxiliary column, to refill the collector, while the first valve is closed and the second valve opens in a controlled manner during restarting of the auxiliary column;
- the liquid is stored up to a level higher than said first control value and, before restarting the auxiliary column, the output of the pump is connected to the upper portion of this auxiliary column, until the liquid level in this latter returns to said first control level.

The invention also has for its object an air distillation installation adapted to practice such a process. This installation, of the type comprising a principal air distillation apparatus comprising oxygen/nitrogen separation means, and an auxiliary argon/oxygen separation column whose base is coupled to the principal apparatus by a gas supply conduit and a liquid return conduit, is characterized in that:

- the auxiliary column comprises a device for recovering the liquid produced by its distillation section; and
- the liquid return conduit is provided with a return valve controlled by a regulator of the liquid level in the auxiliary column, this regulator being of the variable control type.

Examples of use of the invention will now be described with respect to the accompanying drawings, in which:

FIG. 1 shows schematically an air distillation installation according to the invention; and FIGS. 2 to 6 show schematically four variations.

The air distillation installation shown in FIG. 1 is adapted to produce oxygen, nitrogen and argon in gaseous phase. It comprises essentially a double distillation column 1, constituting a principal distillation apparatus which produces oxygen and nitrogen, an auxiliary column or argon column 2, producing at its head gaseous argon containing less than 100 ppm of oxygen, and a coupling pump 3. The double column 1 comprises itself a medium pressure column, or MP column, 4, operating under 5 to 6 bars absolute, surmounted by a low pressure column, or LP column, 5, operating slightly above atmospheric pressure, and a principal vaporizer-condenser 6, which thermally couples the head of the column 4 and the base of the column 5. The installation of course comprises the usual parts, not shown, of double air distillation columns, particularly a principal air compressor, an apparatus for purification of the air from water and carbon dioxide, and a heat exchange line which cools the atmospheric air to be treated by countercurrent heat exchange with the cold products leaving the double column.

The column 2 comprises a head condenser 7, a distillation section 8 of the packed type, and, below this latter, a gas/liquid distributor 9 which serves also to support the packing. This distributor is designed to let pass the gas to be distilled in a manner substantially distributed over all the cross section of the column, and to collect all the liquid from the section 8 and to pour it, via tubing 10, into a peripheral trough 11 fixed below the distributor.

The inlet of pump 3 is freely connected, which is to say without a valve, on the one hand to the trough 11 by a conduit 12, and on the other hand to the base of the column 2 via a conduit 13. The output of the pump is connected on the one hand to an intermediate point in the column 5 by a liquid return conduit 14 provided with a controlled valve 15, and on the other hand to the trough 11 by a recirculation conduit 16 branched upstream of the valve 15 and provided with a controlled valve 17, which opens when its upstream pressure reaches a predetermined value, thanks to an upstream pressure controller 18. The level of liquid in the base of the column 2 can be controlled at a value set by a level controller 19, which sends control signals to a flow controller 20 which controls the valve 15.

In normal operation, in the conventional manner, atmospheric air which is compressed, purified and cooled to about its dew point, is introduced via a conduit 21 into the base of the column 4, which produces at its head medium pressure nitrogen via a conduit 22. "Rich liquid" (air enriched in oxygen) RL is sent from the base of column 4 to an intermediate point of column 5, after expansion in an expansion valve 23, and "poor liquid" (almost pure nitrogen) PL is sent from the head of the column 4 to that of the column 5, after expansion in an expansion valve 24. The column 5 produces at its base low pressure gaseous oxygen, via a conduit 25, and at its head, via a conduit 26, impure nitrogen W, constituting the residual gas of the installation. The vaporizer-condenser 6 causes the liquid oxygen collected at the base of column 5 to boil while condensing the gaseous nitrogen at the head of the column 4.

Again in normal operation, a mixture that is relatively rich in argon and substantially free from nitrogen is withdrawn from an intermediate point of the column 5 via a conduit 27 called "argon injection", and is introduced into the column 2 below the distributor 9. The reflux of column 2 is ensured by vaporization in the condenser 7 of rich liquid from the column 4, first expanded in an expansion valve 28 controlled by the level regulator 28A. The rich liquid thus vaporized returns to the column 5 via a conduit 29 provided with a flow control valve 30.

The level controller 19 maintains a constant low level N1 in the base of the column 2, such that the valve 15 remains open for a flow rate equal to the flow rate of liquid condensed by the condenser 7, and the valve 17 remains closed, or else open for a constant overflow flow rate returned to the trough 11. All the liquid from the distillation section 8 is thus returned via the conduit 14 into the LP column 5.

As indicated above, the column 2 has a height sufficient to produce at its head, via a conduit 31, gaseous argon purified of oxygen, which is to say having typically an oxygen content less than 100 ppm.

There will now be considered the hypothetical case of stoppage of the column 2. This stoppage can be voluntary, or else due to a misfunction of the column 5 leading to an excessive increase of the nitrogen content of the injection argon. Thus, in this case, the condensation temperature at the head of the column 2 falls, because almost all of the argon is located at this place, and as it is not possible to reduce the pressure of the rich liquid in the condenser 7, condensation stops, and with it the withdrawal of gas from the column 5 via the conduit 27.

In this hypothetical case, detected by the wide opening of the valve 30 and by the automatic closure of the valve 28, the pump 3 is stopped. All the liquid contained in the section 8 then descends onto the distributor 9 and into the trough 11, overflowing this latter and collects in the base of the column 2. This base is dimensioned such that the level of the liquid reaches a high level N2 located below the trough 11. This liquid has the mean composition of the assembly of the section 8 in operation, which is to say that it is rich in argon and cannot be returned in large quantity to the column 5, upon restarting, without seriously affecting the purity of the oxygen produced via the conduit 25.

To restart the column 2, one proceeds for this reason in the following manner.

The level N2 being set on the level controller 19 and the valve 30 being closed, the pump 3 is restarted. As no liquid is produced in the section 8, the valve 15 closes, and all the liquid output by the pump is returned, via the conduit 16, to the base of column 2.

Then the condenser 7 is restarted by opening the valves 28 and 30. Gas is then condensed at the head of the column 2, which gives rise to the aspiration of gas via the conduit 27, and liquid poor in oxygen enters the distributor 9 and, from there, the trough 11.

The level N2 continuing to be set by 19, the pump 3 cannot output but the liquid poor in oxygen, via the conduit 12 and the valve 15, which opens upon the flow of this liquid produced in the section 8. The column 5 is thus not polluted by excessive argon.

When the column 2 reaches equilibrium, the level controlled by the controller 19 is progressively lowered from N2 to N1. This gives rise to the progressive and controlled return of the liquid rich in oxygen stored in the base of the column 2, to the column 5, and it is easy to control this process so as not to affect substantially the purity of the oxygen produced by the column 5.

Figure 2:
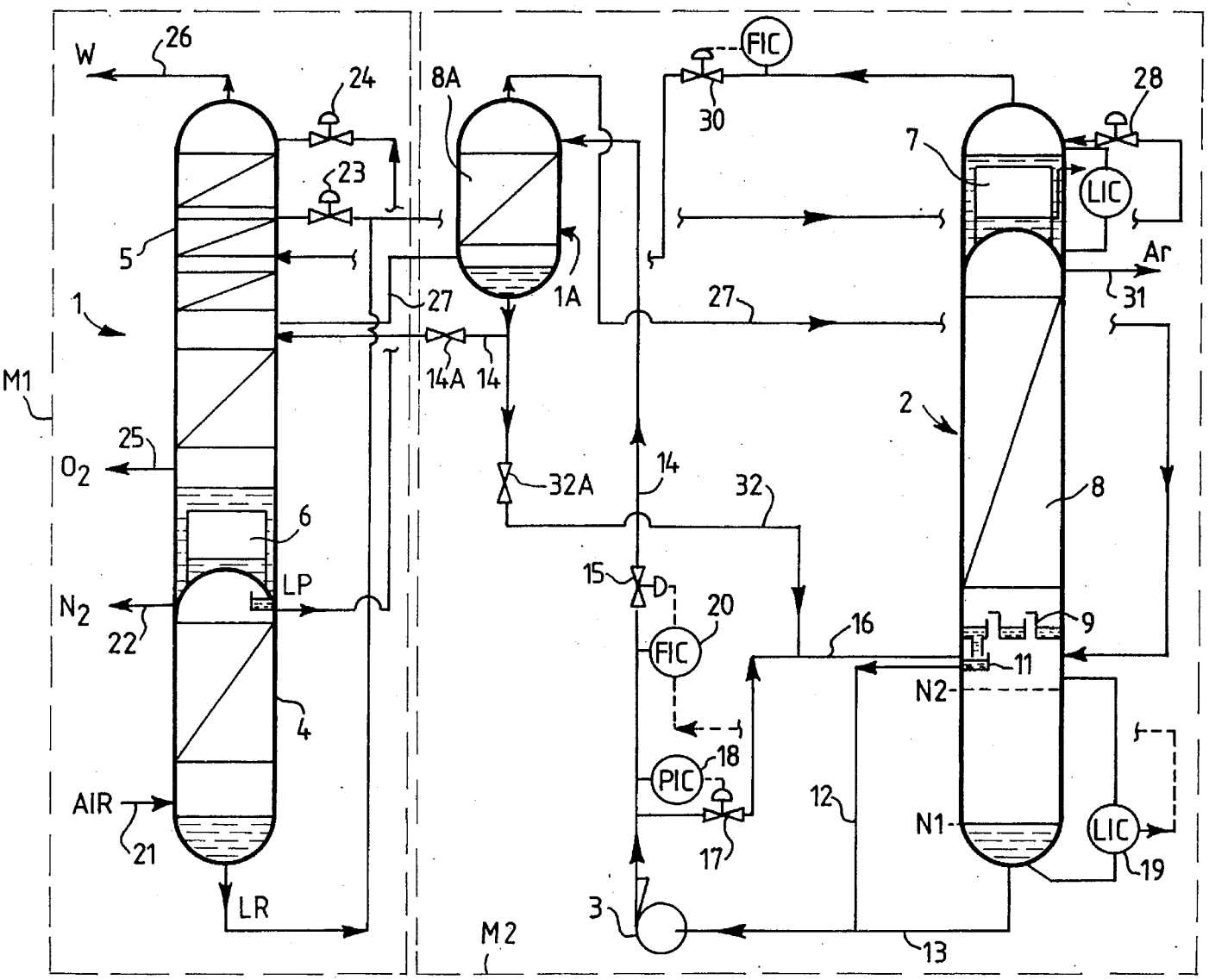

The installation of FIG. 2 differs from that of FIG. 1 only by the fact that the principal apparatus 1 is completed by an argon pre-column 1A interposed between the LP column 5 and the argon column 2. More precisely, the distillation section 8A of the column 1A is interposed on the one hand in the argon injection conduit 27, and on the other hand in the liquid return conduit 14. Moreover, the section of conduit 14 situated between the columns 1A and 5 comprises a normally open valve 14A, and the base of the column 1A is connected to the column 16, downstream of the valve 17, by a conduit 32 provided with a normally closed valve 32A.

This modification, which operates in the same manner as the preceding, permits reducing the height of the column 2. However, during stoppage of the column 2, the valve 14A is closed and the valve 32A is opened. It could be said that, in this case, the connection between the base of the column 2 and the column 5 is indirect, instead of being direct as in the case of FIG. 1.

The installation of FIG. 2 can be designed to be modular, with a first module M1 which contains the double column 1 and its accessories and a second module M2 which contains the columns 1A and 2 and their accessories. Each module comprises a support framework and, after transportation to the job site, it suffices to reconnect the connecting piping.

Figure 3:
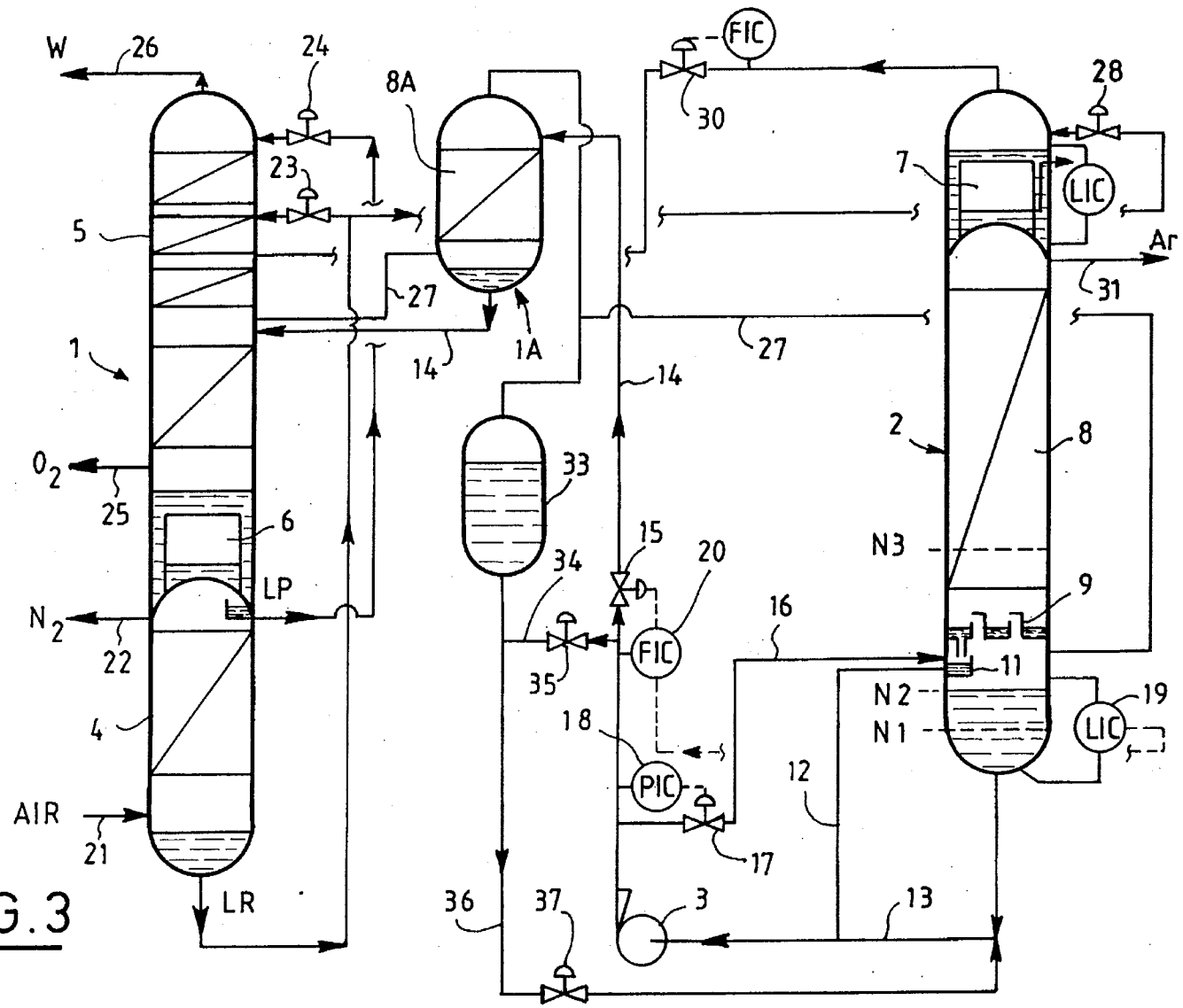

FIG. 3 shows a modification of FIG. 2 which comprises moreover a closed collector 33, empty of liquid in normal operation, located below the column 1A and at a level higher than that of the base of the column 2. The top of the collector 33 is freely connected to the conduit 27, and its bottom is connected on one hand to the output of pump 3 by a conduit 34 provided with a normally closed valve 35, and on the other hand to the intake of this pump by a conduit 36 provided with a normally closed valve 37. Moreover, as will be seen by comparing FIGS. 2 and 3, the base of the column 2, below the distributor 9, is much less deep, its volume being reduced by that of the collector 33. This corresponds to a saving in the construction of the column 2 and its thermal shield, as well as to an increase in the flexibility of use of the various portions of the installation.

During stoppage of the column 2, the liquid rises to the high level N3, at which it immerses the distributor 9, the gas inlet via the conduit 27 and the lower portion of the distillation section 8. Before restarting, the valve 35 is open, the valve 37 remaining closed, and the pump 3 is started. Given the level of positioning of the collector 33, the pump starts to refill this latter with liquid rich in argon, until the level of the liquid in the base of column 2 returns to level N2 set in 19, just below the trough 11. The inlet of gas via conduit 27 is then exposed. The valve 35 is closed, the condenser 7 is started, then operation is conducted as described above, with the exception that the valve 37 is opened slightly. Thus, the progressive return to low level N1 is accompanied by a progressive emptying of the collector 33. When this latter is entirely empty, the valve 37 is closed.

Figure 4:
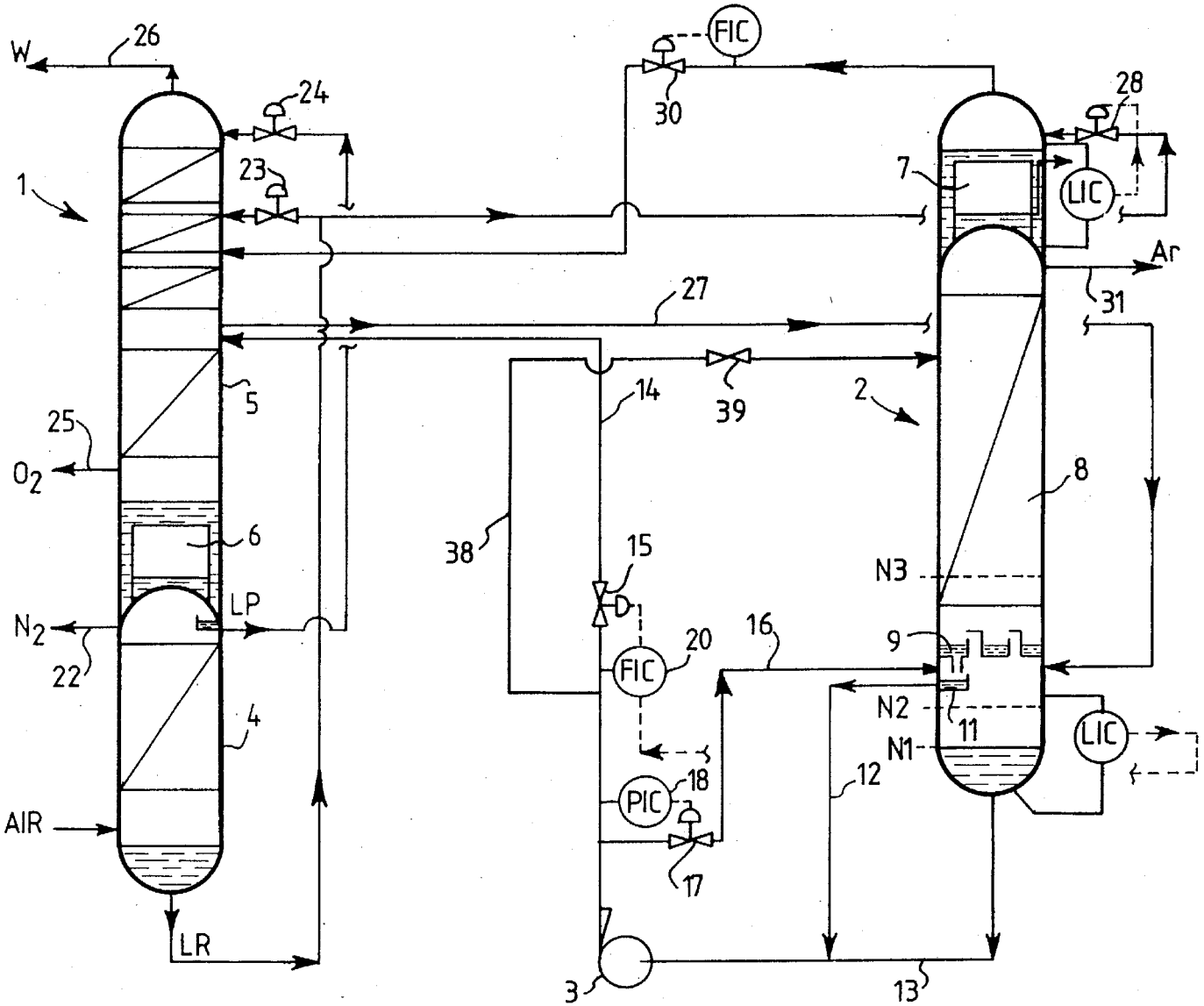

FIG. 4 shows another manner for reducing the height of the base of the column 2, used with the basic arrangement of FIG. 1.

In this modification, there is provided a supplemental return conduit 38 branched from the conduit 14 between the conduit 16 and the valve 15, provided with a normally closed valve 39 and connected to the upper portion of the distillation section 8.

Again, during stoppage of the column 2, the liquid level is the mentioned high level N3. Before restarting, the valve 39 is opened and the pump 3 is operated. Liquid rich in argon is thus recycled in the upper portion of the section 8, and the level of liquid in the column 2 falls to level N2, while exposing the gas inlet from the conduit 27. In the course of this step, excess liquid can be returned via conduit 16 to the trough 11.

Then, the condenser 7 is started, the valve 39 is progressively closed, and the valve 15, under control of the level controller 19, opens to return to the LP column 5 an increasing flow of liquid, which is necessary to maintain the level at the constant value N2 in the base of the column 2. When the valve 39 is closed, restarting is effected as described above.

Figure 5:
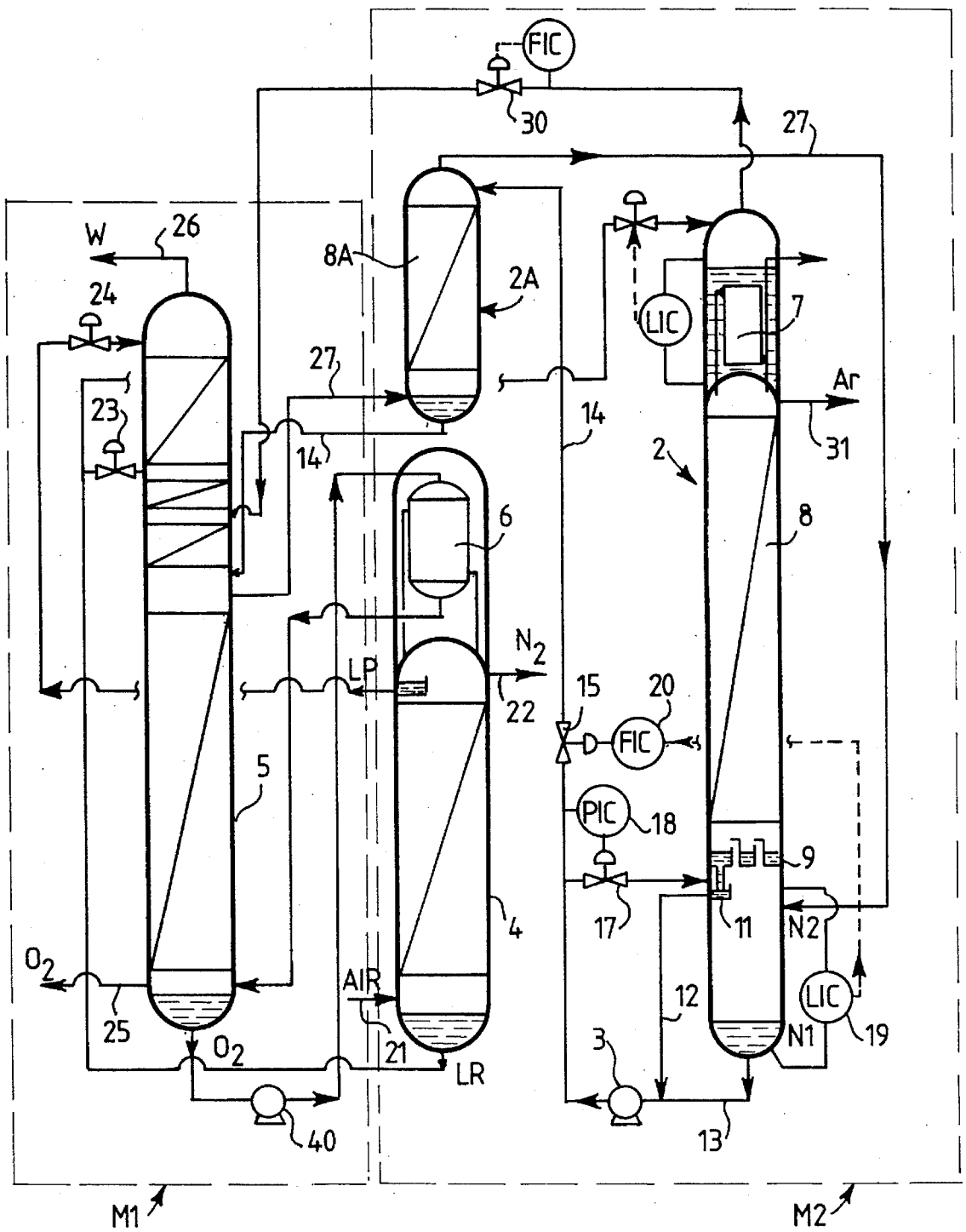

FIG. 5 shows a modification of the installation of FIG. 2 which comprises a particularly compact arrangement of columns, given their heights: MP column 4 and the vaporizer-condenser 6 which surmounts it are mounted beside the lower portion of the LP column 5, with an auxiliary pump 40 to supply oxygen to be vaporized from the bottom of the column 5 to the vaporizer-condenser 6, and the column 2A is mounted above the assembly 4, 6.

As shown above with respect to FIG. 2, the installation can be produced in the form of two modules interconnected on site: a module M1 containing solely the LP column 5 and its accessories, and a module M2 containing columns 1A, 2 and 4 and their accessories.

Figure 6:
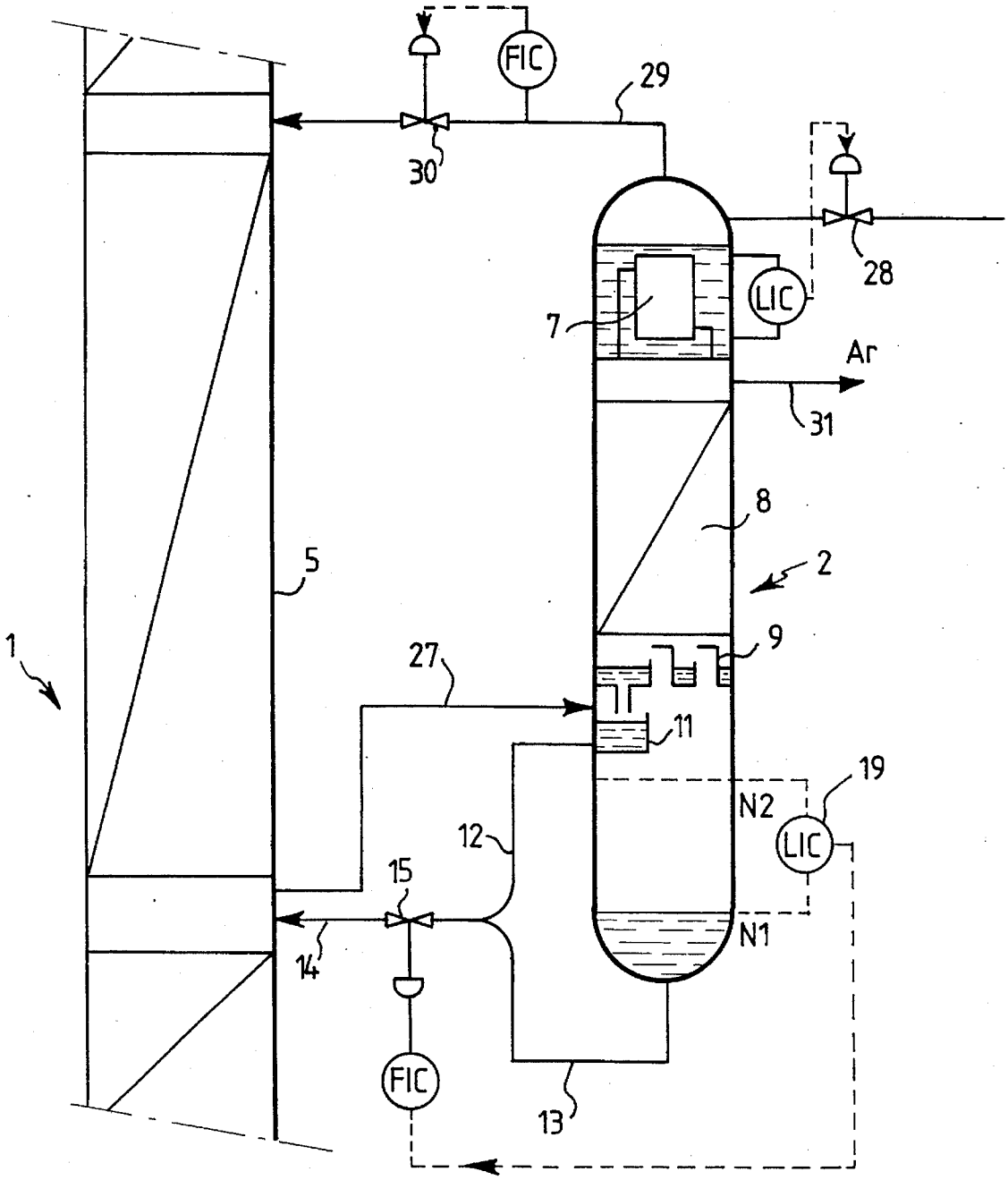

The modified installation shown partially in FIG. 6 differs from those described previously by the fact that it comprises an argon column 2 of much lower height, if desired with distillation plates, supplying at its head, via the conduit 31, impure argon containing typically 2% of oxygen (often called "argon mixture"), adapted to be purified of oxygen in another apparatus (not shown). The column 2 is then arranged to control the LP column 5, which is to say that the normal level N1 in the base of the column 2 is at a level at least equal to that of the junction of the conduit 14 with the column 5.

In this case, the arrangement is the same as in FIG. 1, except that the pump 3 and the conduit 16 are omitted.

The operation of the modification of FIG. 6 is the following.

In normal operation, the conduits 12 and 14 return to the column 5 the liquid from the column 2 collected in the trough 11, the level in the base being maintained at the low level N1.

When the condenser 7 no longer functions, for example because of an excess of nitrogen in the conduit 27, the valve 28 closes and the valve 30 opens wide. Liquid from the controlling column 2 on the packing or on the plates 8 flows, through the distributor 9 and the trough 11, to the base of the column, and the level changes abruptly from N1 to N2. The valves 30 and 15 are then closed.

Upon restarting, the level N2 is set on the controller 19. The valve 15 is closed. The valves 30 and 28 are open, which starts the condenser and the aspiration of gas from the column 5 through the conduit 27.

The level N2 remaining set, only the liquid from the section 8 returns to the column 5. Then, as described above, the level set on the controller 19 is progressively returned from N2 to N1.

We claim:

1. In a process for restarting an auxiliary column for argon/oxygen separation by distillation, coupled to a principal air distillation apparatus in which is effected at least one oxygen/nitrogen separation, of the type in which the liquid contained in the auxiliary column during stoppage of this latter is stored, then this liquid is recycled; the improvement comprising connecting the base of the auxiliary column to the principal apparatus by a liquid return conduit provided with a return valve; connecting the inlet of said return valve to a device for the recovery of liquid from the distillation section of the auxiliary column; and during restarting of the auxiliary column, controlling the return valve while maintaining a constant level in the base of the auxiliary column, at the outset at a first predetermined control value, then while progressively reducing the control value of the constant level.

2. Process according to claim 1, further comprising carrying out in the principal distillation apparatus a pre-separation of argon/oxygen in an argon pre-column whose base is directly connected, by a gas supply conduit and by a liquid return conduit, to a column for oxygen/nitrogen separation by distillation, and whose head is connected to the base of the auxiliary column by a gas supply conduit and by said liquid return conduit.

3. Process according to claim 1, further comprising causing liquid in the return conduit to circulate by means of a pump mounted upstream of the return valve and whose intake is directly connected to the base of the auxiliary column and to the recovery device.

4. Process according to claim 3, further comprising connecting the output of the pump to the recovery device by a recirculation conduit provided with a recirculation valve.

5. Process according to claim 3, further comprising storing a portion of the liquid in a collector connected to the output of the pump by a derivation conduit provided with a first valve, connecting the base of this collector to the intake of the pump by another conduit provided with a second valve, opening the first valve and closing the second valve during stoppage of the auxiliary column, to refill the collector, and closing the first valve and opening the second valve in a controlled manner during restarting of the auxiliary column.

6. Process according to of claim 3, further comprising storing the liquid up to a level higher than said first control value and, before restarting the auxiliary column, connecting the output of the pump to the upper portion of this auxiliary column, until the liquid level in this latter returns to said first control value.

7. Air distillation installation, comprising a principal apparatus for the distillation of air comprising oxygen/nitrogen separation means (4, 5), and an auxiliary column for argon/oxygen separation whose base is coupled to the principal apparatus by a gas supply conduit and a liquid return; the improvement wherein the auxiliary column comprises a device for the recovery of liquid produced by its distillation section; and the liquid return conduit is provided with a return valve controlled by a regulator of the liquid level in the auxiliary column, this regulator being of variable control.

8. Installation according to claim 7, wherein the principal distillation apparatus comprises an argon pre-column whose base is directly connected, by a gas supply conduit and by a liquid return conduit, to a column for oxygen/nitrogen separation by distillation, and whose head is connected to the base of the auxiliary column by a gas supply conduit and by said liquid return conduit.

9. Installation according to claim 7, wherein the return conduit is provided with a pump mounted upstream of the return valve and whose intake is directly connected to the base of the auxiliary column and to the recovery device.

10. Installation according to claim 9, wherein the output of the pump is also connected to the recovery device, via a recirculation conduit provided with a recirculation valve.

11. Installation according to claim 9, which further comprises a collector connected to the outlet of the pump by a derivation conduit provided with a first valve, the base of this collector being connected to the intake of the pump by another conduit provided with a second valve.

12. Installation according to claim 9, wherein the output of the pump is also connected, via a return conduit provided with a valve, to the upper portion of the auxiliary column.

* * * * *